US006837255B2

(12) United States Patent
Bunch et al.

(10) Patent No.: US 6,837,255 B2
(45) Date of Patent: Jan. 4, 2005

(54) ILLUMINATED UMBRELLA ASSEMBLY HAVING SELF-CONTAINED AND REPLACABLE LIGHTING

(76) Inventors: Colette M. Bunch, 4637 E. Dale La., Cave Creek, AZ (US) 85331; Shaheen T. Shaheen, 1206 Wreckenridge, Flint, MI (US) 48532

( * ) Notice: Subject to any disclaimer, the term of this patent is extended or adjusted under 35 U.S.C. 154(b) by 74 days.

(21) Appl. No.: 10/219,034

(22) Filed: Aug. 13, 2002

(65) Prior Publication Data

US 2004/0031513 A1 Feb. 19, 2004

(51) Int. Cl.[7] ..... A45B 3/04
(52) U.S. Cl. ..... 135/16; 135/910; 362/102
(58) Field of Search ..... 135/910, 16; 362/102, 362/253, 240, 237

(56) References Cited

U.S. PATENT DOCUMENTS

| | | | | | |
|---|---|---|---|---|---|
| 3,755,663 | A | * | 8/1973 | George, Jr. | 362/249 |
| 5,007,811 | A | | 4/1991 | Hopkins | |
| 5,053,931 | A | * | 10/1991 | Rushing | 362/102 |
| 5,273,062 | A | * | 12/1993 | Mozdzanowski | 135/16 |
| 5,584,564 | A | * | 12/1996 | Phyle | 362/102 |
| 5,611,614 | A | * | 3/1997 | Morgan | 362/102 |
| 6,017,188 | A | | 1/2000 | Benton | |
| 6,089,727 | A | * | 7/2000 | Wu | 362/102 |
| 6,340,233 | B1 | * | 1/2002 | Shieh | 362/102 |
| 6,439,249 | B1 | * | 8/2002 | Pan et al. | 135/16 |
| 6,499,856 | B2 | * | 12/2002 | Lee | 362/102 |
| 6,598,990 | B2 | * | 7/2003 | Li | 362/102 |
| 6,612,713 | B1 | * | 9/2003 | Kuelbs | 362/102 |
| 2003/0084931 | A1 | * | 5/2003 | Lee | 135/16 |

FOREIGN PATENT DOCUMENTS

| | | | | |
|---|---|---|---|---|
| FR | 2 599 228 | * | 12/1987 | A45B/3/04 |
| FR | 2627679 A | * | 9/1989 | A45B/3/04 |

OTHER PUBLICATIONS

FRONTGATE "Remote Lighted Umbrella" from frontgate-.com.

* cited by examiner

*Primary Examiner*—Robert Canfield
(74) *Attorney, Agent, or Firm*—John R. Mugno

(57) ABSTRACT

An illuminated umbrella assembly having self-contained and protected lights is described. The illuminated umbrella assembly comprises (i) a lower vertical support pole having a first end for engagement to a generally horizontal surface and a second end extending upwardly there from; (ii) an upper vertical support pole having a first end coupled to the second end of the lower vertical support pole and a second end extending upwardly there from; (iii) a plurality of umbrella support bars extending from the second end of the upper vertical support pole; (iv) an umbrella panel overlaying and coupled to the plurality of umbrella support bars; (v) a hinged column coupled coaxially around and selectively movable along the upper vertical support pole; (vi) a plurality of hollowed, elongated and non-opaque support rails, each having a first end coupled to the hinged column and a second end coupled to one of the plurality of umbrella support bars; (vii) a plurality of light strands positioned internally within and extending substantially along the length of the plurality of hollowed, elongated and non-opaque support rails, each of the plurality of light strands having one of a plurality of plugs on one end thereof; (viii) a battery sleeve containing a series of rechargeable DC batteries wherein the battery sleeve is contained coaxially within the lower vertical support pole and is electrically wired to provide power to the light strands by including outlets to engage with said plugs; (ix) a solar panel overlaying at least a portion of the umbrella panel and electrically wired to provide power to the light strands through the outlets; and (x) a plurality of coupling hinges for individually attaching the second ends of the support rails to the plurality of umbrella support bars. A power switch is often provided to control the illumination of the light strands.

20 Claims, 6 Drawing Sheets

ILLUMINATED UMBRELLA ASSEMBLY HAVING SELF-CONTAINED AND REPLACABLE LIGHTING

FIELD OF THE INVENTION

This invention is generally directed to an umbrella assembly for placement directly on the ground or as part of a patio table ensemble. More specifically, the illuminated umbrella assembly of the present invention provides self-contained lighting for both practical and decorative purposes wherein the lighting is easily replaceable and protected from damage. Moreover, the lighting provided in the novel umbrella assembly can be powered by various self-contained power supply means.

BACKGROUND OF THE INVENTION

In both commercial and residential settings, the use of large umbrellas has become commonplace to both provide protection from the elements and to create a quaint environment for meals, cocktails, or discussion. There exist in the prior art numerous types of umbrellas for use on a deck or patio, ranging from simple, inexpensive spring-controlled umbrellas that do little more than go up and down, to umbrellas that are remote-controlled, operated by solar power, include fans, provide cooling mist, etc.

As an example of the prior art, Hopkins U.S. Pat. No. 5,007,811 describes a retrofit electric fan that can be coupled to a patio umbrella without removing the umbrella. The fan can incorporate an exposed light. Thus it is subject to damage from either people sitting around the patio table or by the elements. In addition, such exposed lighting is typically expensive and requires a large supply of power. As another example of the prior art, Benton U.S. Pat. No. 6,017,188 provides a patio table and fan combination. The described apparatus is utilized as a fan mounted on a pole that passes through the center of the patio table. The pole can also support an umbrella that can be used for shade when the table is located outside. For aesthetic design purposes, the fan motor is mounted co-axially with the fan. The disclosed apparatus can also include pole mounted lights and a mist device. In alternative embodiments, the described patio table fan combination can be powered by a conventional household electrical outlet or by solar panels mounted on the disclosed apparatus. However, the mounted lights, which are coupled to the vertical mounting pole, are external to the umbrella assembly and thus are easily broken.

It is therefore primary object of the present invention to provide a new and improved umbrella assembly which includes removable lighting.

It is another object of the present invention to provide a new and improved umbrella assembly which includes lighting that is protected from damage by being internally placed within the umbrella assembly.

It is yet a further object of the present invention to provide a new and improved umbrella assembly which includes lighting that is inexpensive and requires low power.

It is yet still a further object of the present invention to provide a new and improved umbrella assembly which includes lighting that can be operated from various and alternative power supplies.

It is still another object of the present invention to provide a new and improved umbrella assembly wherein the assembly is secure yet easily detachable to replace the lighting provided therein.

It is an additional object of the present invention to provide a new and improved umbrella assembly wherein the umbrella assembly can be either free-standing by utilizing an umbrella support stand or be utilized as part of a patio table ensemble.

Other objects and advantages of the present invention will become apparent from the specification and the drawings.

SUMMARY OF THE INVENTION

Briefly stated and in accordance with the preferred embodiment of the present invention, an umbrella assembly having self-contained and easily replaceable lighting is described. The illuminated umbrella assembly comprises (i) a lower vertical support pole having a first end for engagement to a generally horizontal surface and a second end extending upwardly there from; (ii) an upper vertical support pole having a first end coupled to the second end of the lower vertical support pole and a second end extending upwardly there from; (iii) a plurality of umbrella support bars extending from the second end of the upper vertical support pole; (iv) an umbrella panel overlaying and coupled to the plurality of umbrella support bars; (v) a hinged column coupled coaxially around and selectively movable along the upper vertical support pole; (vi) a plurality of hollowed, elongated and non-opaque support rails, each having a first end coupled to the hinged column and a second end coupled to one of the plurality of umbrella support bars; (vii) a plurality of light strands positioned internally within and extending substantially along the length of the plurality of hollowed, elongated and non-opaque support rails, each of the plurality of light strands having one of a plurality of plugs on one end thereof; (viii) a battery sleeve containing a series of rechargeable DC batteries wherein the battery sleeve is contained coaxially within the lower vertical support pole and is electrically wired to provide power to the light strands by including outlets to engage with said plugs; (ix) a solar panel overlaying at least a portion of the umbrella panel and electrically wired to provide power to the light strands through the outlets; and (x) a plurality of coupling hinges for individually attaching the second ends of the support rails to the plurality of umbrella support bars. A power switch is often provided to control the illumination of the light strands. The present umbrella assembly can utilize an umbrella support stand to be free-standing, or be utilized as part of a patio table ensemble.

BRIEF DESCRIPTION OF THE DRAWINGS

While the specification concludes with claims particularly pointing out and distinctly claiming the subject matter regarded as the invention herein, it is believed that the present invention will be more readily understood upon consideration of the description, taken in conjunction with the accompanying drawings, wherein:

DESCRIPTION OF THE PREFERRED EMBODIMENT

Figure 1:
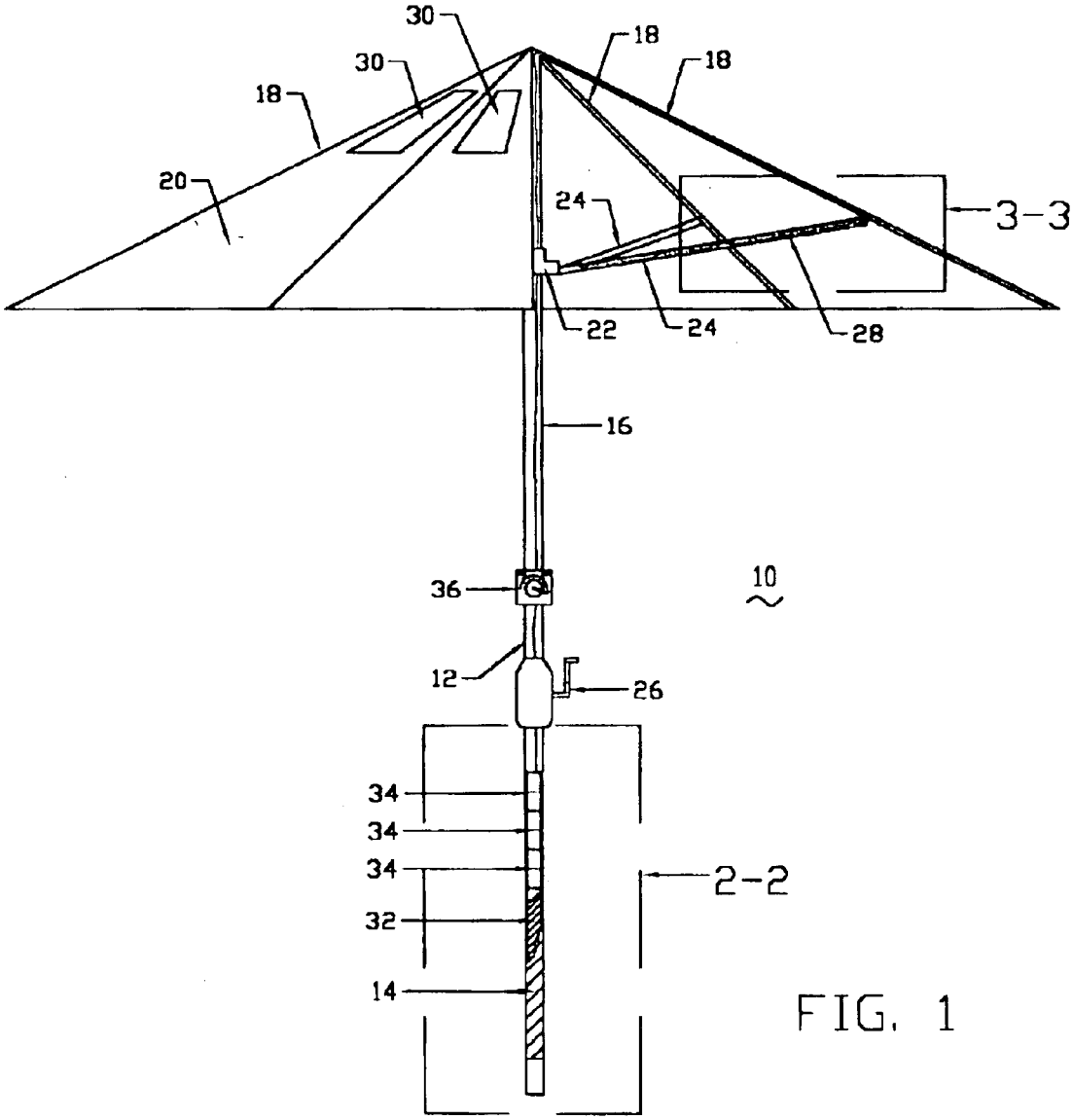
FIG. 1 is a schematic illustration of the preferred embodiment of an illuminated umbrella assembly in accordance with the present invention.

Referring first to FIG. 1, an illuminated umbrella assembly generally designated 10 is shown that represents a preferred embodiment of the present invention. Illuminated umbrella assembly 10 includes a vertical support pole 12. In order to provide for convenient manufacturing, shipping, storage, and handling, vertical support pole 12 can optionally be subdivided into a lower vertical support pole 14 and an upper vertical support pole 16.

As is the case in most standard umbrellas, a plurality of umbrella support bars 18 extend from the top end of upper vertical support pole 16. An umbrella panel 20, which can be comprised of numerous water-proof materials known to those skilled in the art, overlays umbrella support bars 18. Umbrella panel 20 can be comprised of a single sheet of material or individual panels between adjacent umbrella support bars 18. Whether comprised of a unitary panel or of various individual components, umbrella panel 20 provides shade to users sitting or standing under umbrella assembly 10. A selectively moving hinged column 22 is axially movable around upper vertical support pole 16. Extending from hinged column 22 are a plurality of illuminated support rails 24 which extend from hinged column 22 to individual umbrella support bars 18. In order to simplify FIG. 1, only two support rails have been illustrated. However, it will be understood by those skilled in the art that typically there are an equal number of support rails 24 as there are umbrella support bars 18.

In order to provide the novelty of the present invention, support rails 24 will be made of non-opaque materials. Support rails 24 will typically be tubular and can be transparent, or tinted, to create different types of lighting. The illumination of support rails 24 will be described in more detail herein. The movement of hinged column 22 upwardly and downwardly along upper vertical support pole 16 is controlled in the preferred embodiment by means of a crank 26. When crank 26 is rotated in one direction, hinged column 22 will move upwardly thereby opening umbrella assembly 10. Conversely, when crank 26 is rotated in the opposite direction, hinged column 22 will move downwardly thereby closing umbrella assembly 10. While the preferred embodiment envisions the use of a crank to control the opening and shutting of umbrella assembly 10, numerous variations also exist. For instance, newer umbrellas permit wireless control of the opening and closing of an umbrella. Additionally, a spring-actuated pin mechanism can also be provided. Other variations also exist in the art.

Light strands 28 can be provided in each hollowed, elongated and non-opaque support rail 24 to provide both functional and decorative lighting to umbrella assembly 10. Electrical power can be supplied to light strands 28 by various means including a standard outlet. However, if a standard outlet is utilized, it often limits the positioning of umbrella assembly 10 and creates a hazard upon which users might trip. Thus, in the preferred embodiment, solar panels 30 are provided which overlay at least a portion of umbrella panel 20 to a sufficient extent to provide adequate power to illuminate light strands 28. A battery sleeve 32 is also provided which can hold a series of rechargeable DC batteries 34 sufficient to provide adequate power to light strands 28. Numerous variations on how the solar panels 30 and rechargeable batteries 34 are implemented can be envisioned. For instance, in sunny locations, solar panels 30 can provide the main source of power to light strands 28. When insufficient energy is generated by the sun, batteries 34 can provide backup power. In another variation, batteries 34 can be rechargeable by solar panels 30, thereby storing sufficient energy, so that, whether or not the sun was shining, sufficient power can be provided to light strands 28. A dimmer switch 36 is provided on vertical support pole 12 to permit user control of light strands 28. Of course, a simple ON-OFF switch, a motion sensor element, or a wireless remote can also be incorporated and such control means can be positioned at any convenient part of illuminated umbrella assembly 10.

Figure 2:
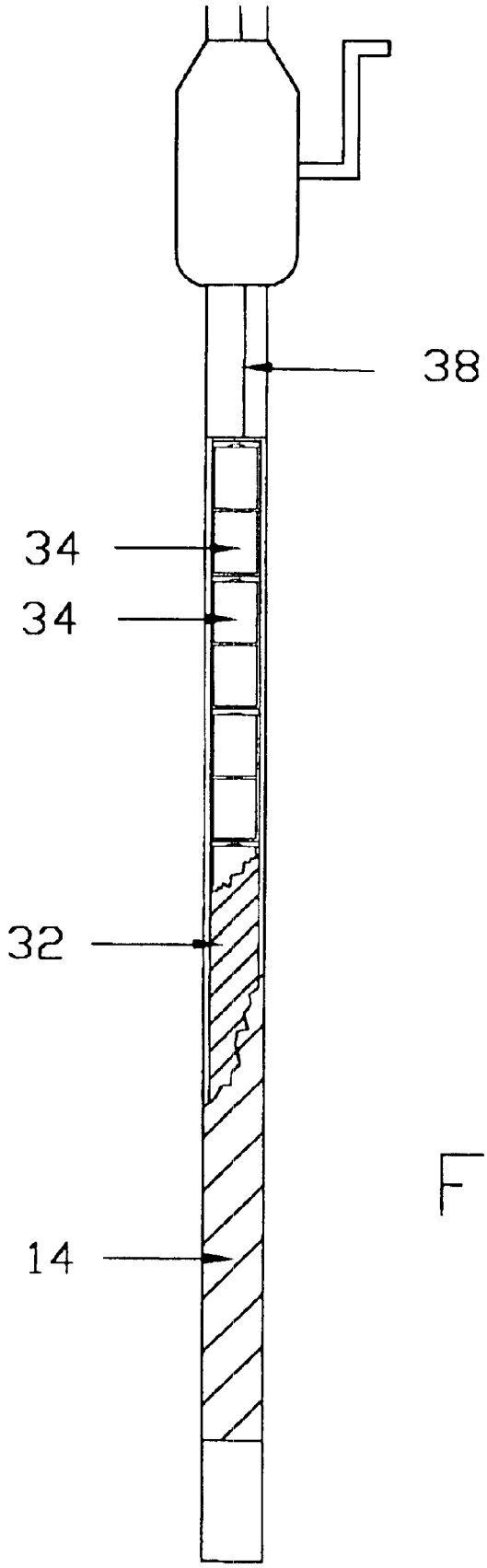
FIG. 2 is an exploded view of the portion of FIG. 1 as represented by dashed box 2—2.
Figure 3:
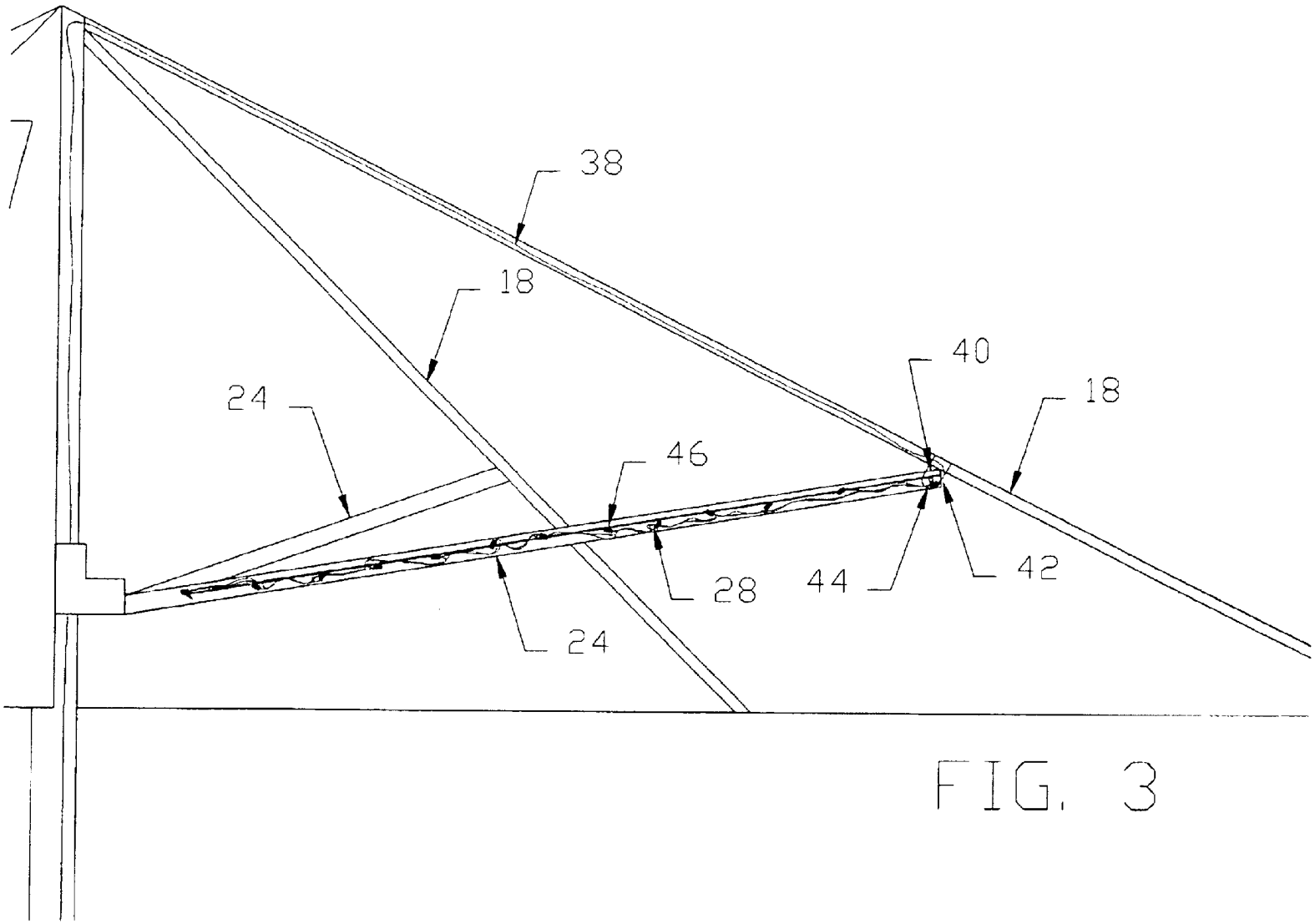
FIG. 3 is an exploded view of the portion of FIG. 1 as represented by dashed box 3—3.
Figure 4B:
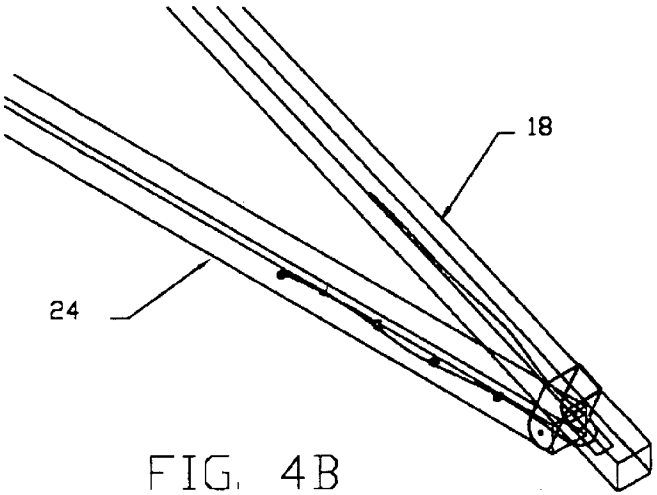
FIGS. 4A, 4B, 4C, and 4D are top, three-dimensional, front and right side exploded views, respectively, of a support rail, a coupling hinge, and support bar interconnection of FIG. 3.
Figure 4D:
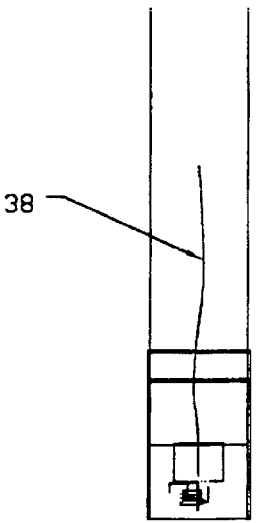
Figure 4A:
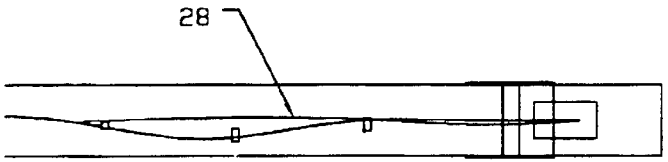
Figure 4C:
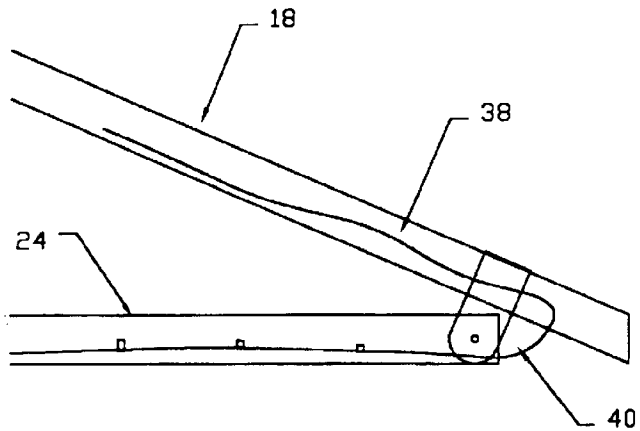

FIG. 2 reflects an exploded view of dashed box 2—2 of FIG. 1. Contained co-axially within lower vertical support pole 14 is a battery sleeve 32 which contains a sufficient number of batteries 34 to power light strands 28. Electrical wiring 38 extends upwardly through vertical support pole 12. Electrical wiring 38 continues downward through each umbrella support bar 18 to the point where support rail 24 interconnects with umbrella support bar 18. This extension of electrical wiring 38 is best seen in FIG. 3, which is an exploded representation of dashed box 3—3 of FIG. 1. A pinned coupling hinge 40 is provided to selectively couple each support rail 24 to each umbrella support bar 18. Electrical wiring 38 runs through coupling hinge 40 and terminates in an outlet 42 which can engage a plug 44 of light strands 28. The terms outlet and plug as incorporated herein are simply utilized to reflect some form of electrical mating between the power source and light strands 28. FIG. 4A provides a top view of the interconnection between support rail 24 and coupling hinge 40; FIG. 4B provides a three-dimensional view of the interconnection between support rail 24 and coupling hinge 40; FIG. 4C provides a front view of the interconnection between support rail 24 and coupling hinge 40; and FIG. 4D provides a right side view of the interconnection between support rail 24 and coupling hinge 40. As can be seen, electrical wiring 38 can move along with the movement of hinge 40 without being damaged.

One advantage of the present invention is that light strands 28, which would preferably take the form of inexpensive and low-power lights such as Christmas lights, can be easily changed either due to malfunction or to create a different environment. For instance, alternating red and green lights might be utilized within support rails 24 for Christmas events, whereas orange bulbs might seem more appropriate for Halloween festivities. Regardless of their color, light strands 28 will provide the most efficient illumination and most aesthetically pleasing appearance when they are uniformly distributed along the length of non-opaque support rail 24. It has been determined through experimentation that a flexible light strand insertion rod 46 is useful to achieve this effect. Light strand insertion rod 46 is rigid enough to pierce the length of support rail 24 while holding on to an end of light strand 28, yet flexible enough to easily and selectively be removed from support rail 24 once proper insertion of light strand 28 has been achieved.

Figure 5:
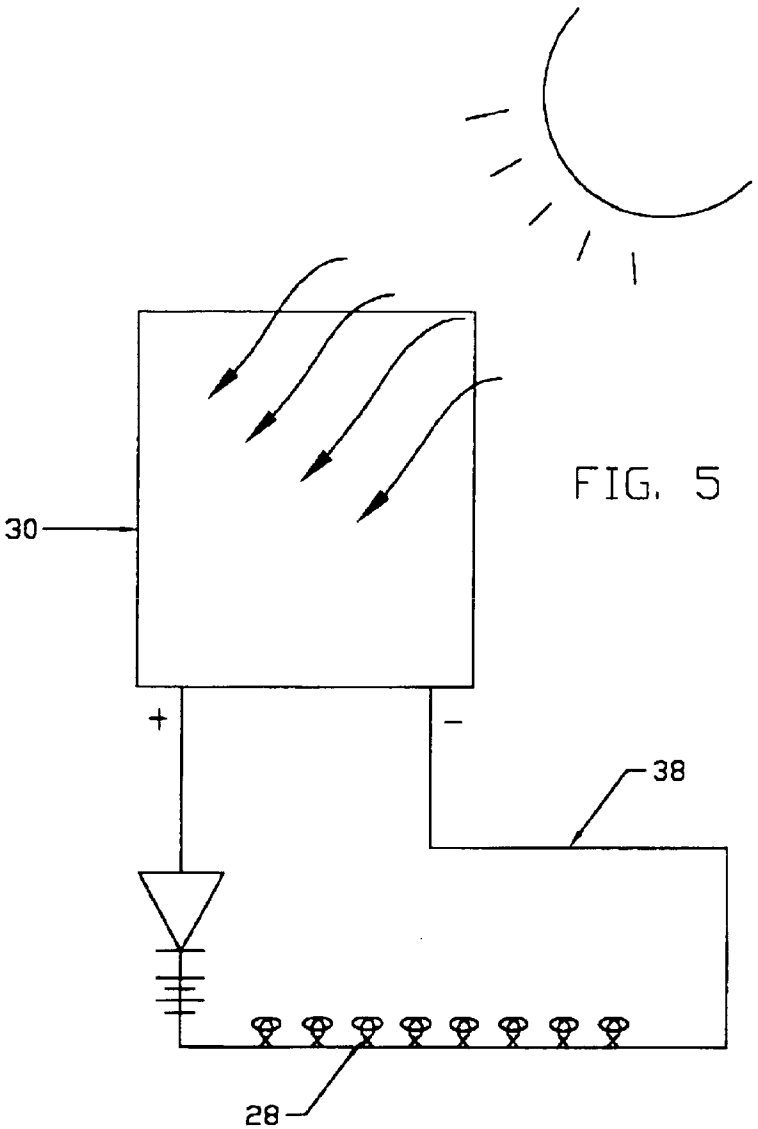
FIG. 5 is a schematic illustration of the powering of lights strands incorporated in the present invention by means of a provided solar panel.

Electrical wiring 38 can also extend directly from outlet 42 to solar panels 30. FIG. 5 provides a schematic illustration on how solar panels 30 provide power to light strands 28. Solar panels 30 can be the primary source of power or utilized to recharge batteries 34.

Figure 6:
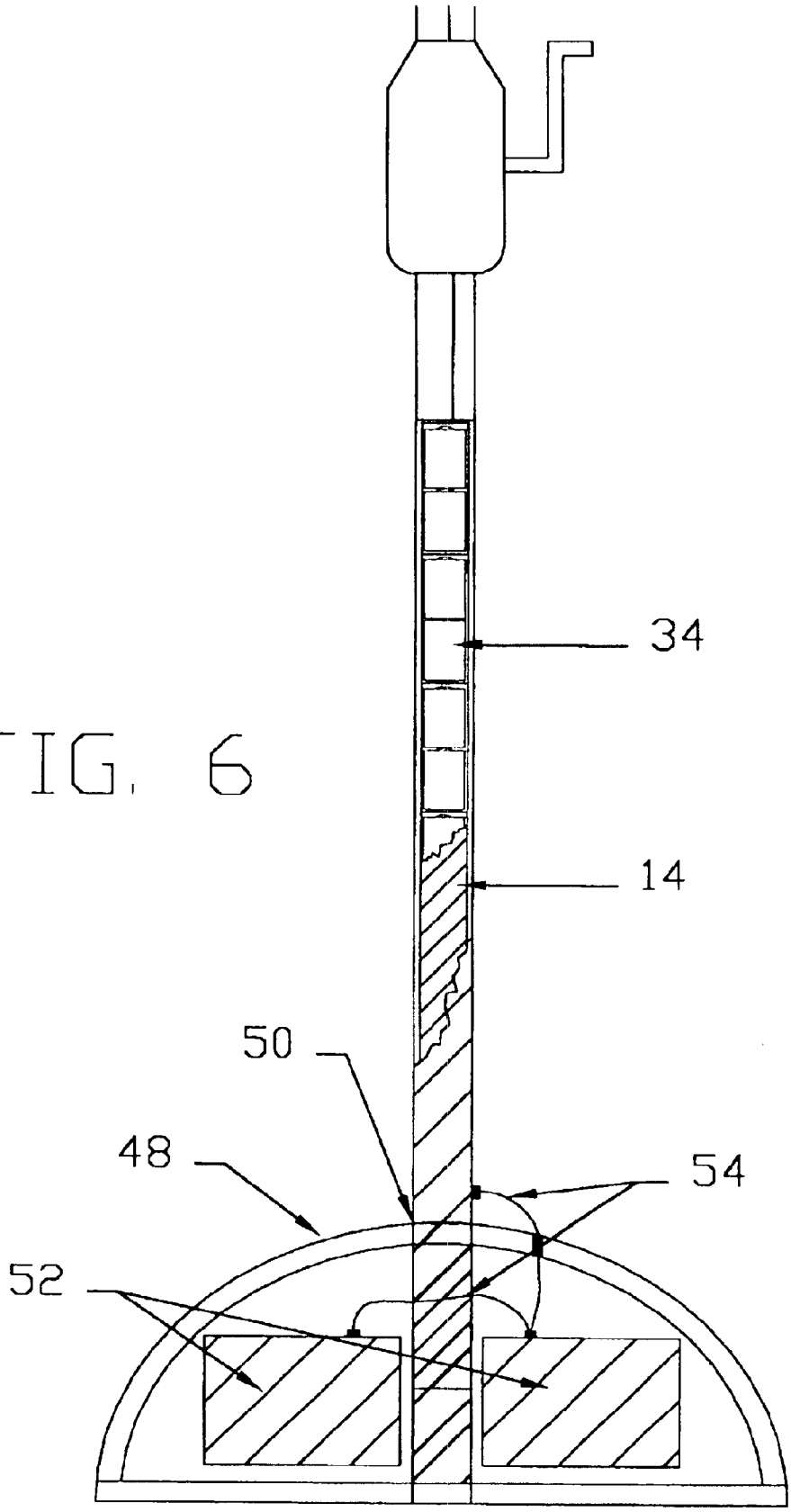
FIG. 6 is a schematic illustration of the umbrella assembly of the present invention utilized in conjunction with an umbrella support stand to render the umbrella assembly free-standing.

Illuminated umbrella assembly 10, as shown in FIG. 1, can be utilized in conjunction with a patio table ensemble (not shown) in ways known in the art. In essence, umbrella assembly 10 is inserted into a circular slot in the middle of the table. Although vertical support pole 12 of umbrella assembly 10, in such instances, pierces through the circular slot of the table, it is deemed to be engaged with the generally horizontal surface of the table. As another embodiment, illuminated umbrella assembly 10 can also be made to be free-standing by utilizing a support stand, such as support stand 48, shown in FIG. 6. Umbrella support stand 48 should have a significant enough width, height, and weight so as to prevent umbrella assembly 10 from tipping over. Umbrella support stand 48 can be coupled to umbrella assembly 10 by inserting lower vertical support pole 13 through a hollowed slot 50 on umbrella support stand 48. The interconnection between lower vertical support pole 13 and umbrella support stand 48 can be secured in numerous ways including by the use of screws, bolts, pins, etc. Moreover, the interconnection between lower vertical support pole 14 and umbrella support stand 48 can be of a unitary design.

Umbrella support stand 48 can optionally be made to include batteries 52 and corresponding electrical wiring 54 for the purposes of illuminating light strands 28. It will further be noted that while umbrella support stand 48 has been illustrated in a dome-shaped form, numerous variations are feasible. Umbrella support stand 13 can take on any shape as long as it is sufficiently sturdy to support umbrella assembly 10 without falling over.

It will be apparent from the foregoing description that the present invention provides a new and improved illuminated umbrella assembly which is low-power, inexpensive, and self-contained. While a specific and effective preferred embodiment has been described, numerous alternatives exist. For instance, the support rails have been described as non-opaque simply to illustrate that some light needs to be passable through them. However, the support rails can either be transparent or include a tint to create any desired effect; as used herein and in the following claims the term "non-opaque" will include any such alternatives. Moreover, while the illuminated umbrella assembly of the present invention will be most aesthetically pleasing when each of its support rails includes lighting, there is no requirement to provide maximum lighting in order for the subject invention to be functional.

While there has been shown and described what is presently considered to be the preferred embodiment of this invention, it will obvious to those skilled in the art that various changes and modifications may be made without departing from the broader aspects of this invention. For instance, the illuminated umbrella assembly of the present invention can be modified to include a self-powered fan, a misting system, etc. to enhance its functionality without departing from the scope of the present invention. Moreover, the illuminated umbrella assembly of the present invention can be made in a unitary form or of various components to simplify shipping.

It is, therefore, aimed in the appended claims to cover all such changes and modifications as fall within the true scope and spirit of the invention

We claim:

1. An illuminated umbrella assembly comprising:

a vertical support pole;

a plurality of umbrella support bars extending from the top of said vertical support pole;

an umbrella panel overlaying and coupled to said plurality of umbrella support bars;

a hinged column coupled coaxially around and selectively movable along said vertical support pole;

a plurality of hollowed, elongated and non-opaque support rails, each having a first end coupled to said hinged column and a second end coupled to one of said plurality of umbrella support bars;

replaceable lighting encased wholly within at least one of said plurality of hollowed, elongated and non-opaque support rails; and a power supply for illuminating said replaceable lighting.

2. The illuminated umbrella assembly of claim 1 further comprising a power switch to control the illumination of said replaceable lighting.

3. The illuminated umbrella assembly of claim 1 further comprising a crank on said vertical support pole for selectively moving said hinged column, thereby opening or closing said umbrella assembly.

4. The illuminated umbrella assembly of claim 1 wherein said power supply includes a solar panel overlaying at least a portion said umbrella panel.

5. The illuminated umbrella assembly of claim 1 wherein said power supply includes a battery sleeve for containing a series of DC batteries wherein said battery sleeve is contained coaxially within said vertical support pole.

6. The illuminated umbrella assembly of claim 1 wherein said vertical support pole comprises a lower vertical support pole and a upper vertical support pole.

7. The illuminated umbrella assembly of claim 1 comprising a plurality of coupling hinges for selectively attaching the second end of each hollowed, elongated and non-opaque support rail to one of said plurality of umbrella support bars.

8. The illuminated umbrella assembly of claim 7 wherein said replaceable lighting is a strand of bulbs having a plug on one end of said strand.

9. The illuminated umbrella assembly of claim 8 further comprising electrical wiring having a first end coupled to said power supply, extending through at least one of said plurality of umbrella support bars to a position near one of said plurality of coupling hinges, and having a second end comprising a socket for electrical engagement with said plug.

10. The illuminated umbrella assembly of claim 9 further comprising a flexible and removable light strand insertion rod for extending said strand of bulbs along the length a said support rail.

11. The illuminated umbrella assembly of claim 1 further comprising an umbrella support stand coupled to said vertical support pole for enabling said illuminated umbrella assembly to be free-standing.

12. The illuminated umbrella assembly of claim 11 wherein said power supply includes a battery contained within said umbrella support stand.

13. An illuminated umbrella assembly comprising:

a lower vertical support pole having a first end for engagement to a generally horizontal surface and a second end extending upwardly therefrom;

an upper vertical support pole having a first end coupled to said second end of said lower vertical support pole and a second end extending upwardly therefrom;

a plurality of umbrella support bars extending from said second end of said upper vertical support pole;

an umbrella panel overlaying and coupled to said plurality of umbrella support bars;

a hinged column coupled coaxially around and selectively movable along said upper vertical support pole;

a plurality of hollowed, elongated and non-opaque support rails, each having a first end coupled to said hinged column and a second end coupled to one of said plurality of umbrella support bars;

a plurality of light strands encased wholly within and extending substantially along the length of said plurality of hollowed, elongated and non-opaque support rails, each of said plurality of light strands having one of a plurality of plugs on one end thereof;

a battery sleeve containing a series of rechargeable DC batteries wherein said battery sleeve is contained coaxially within said lower vertical support pole and is electrically wired to provide power to said light strands by including outlets to engage with said plugs;

a solar panel overlaying at least a portion of said umbrella panel and electrically wired to provide power to said light strands through said outlets; and a plurality of coupling hinges for individually attaching said second ends of said support rails to said plurality of umbrella support bars.

14. The illuminated umbrella assembly of claim 13 further comprising a power switch to control the illumination of said plurality of light strands.

15. The illuminated umbrella assembly of claim 13 further comprising a crank on said lower vertical support pole for selectively moving said hinged column, thereby opening or closing said umbrella assembly.

16. The illuminated umbrella assembly of claim 13 wherein said solar panel is further electrically coupled to said battery sleeve for recharging said batteries.

17. The illuminated umbrella assembly of claim 13 further comprising a flexible and removable light strand insertion rod for extending said light strands along the lengths of said plurality of support rails.

18. The illuminated umbrella assembly of claim 13 further comprising an umbrella support stand coupled to said first end of said lower vertical support pole for enabling said illuminated umbrella assembly to be free-standing.

19. The illuminated umbrella assembly of claim 18 wherein said umbrella support stand further houses a battery electrically wired to provide power to said light strands through said outlets.

20. The illuminated umbrella assembly of claim 19 wherein said solar panel is further electronically coupled to said battery housed within said umbrella support stand for recharging said battery.

* * * * *